United States Patent [19]

Davis et al.

[11] Patent Number: 4,918,887

[45] Date of Patent: Apr. 24, 1990

[54] PROTECTIVE TENDON TENSIONING ANCHOR ASSEMBLIES

[75] Inventors: Edgar A. Davis, San Jose, Calif.; Richard L. Watts, Springfield; John Crigler, Dumfries, both of Va.

[73] Assignee: VSL Corporation, Los Gatos, Calif.

[21] Appl. No.: 109,471

[22] Filed: Oct. 14, 1987

[51] Int. Cl.[5] ..... E04C 5/08

[52] U.S. Cl. ..... 52/223 L; 52/230

[58] Field of Search ..... 52/223 L, 225, 226, 52/230, 223 R; 405/259, 262; 411/542, 369, 915

[56] References Cited

U.S. PATENT DOCUMENTS

| | | | |
|---|---|---|---|
| 1,356,873 | 10/1920 | Monteath | 411/542 |
| 3,448,494 | 6/1969 | Boyenval et al. | 411/542 |
| 3,596,330 | 8/1971 | Scott | 52/223 L |
| 3,820,832 | 6/1974 | Brandestini et al. | 52/223 L |
| 3,844,697 | 10/1974 | Edwards | 52/223 R |
| 3,956,797 | 5/1976 | Brandestini et al. | 52/230 |
| 4,343,122 | 8/1982 | Wlodkowski et al. | 52/223 L |
| 4,348,844 | 9/1982 | Schupack et al. | 52/223 L |
| 4,521,147 | 6/1985 | King, Jr. et al. | 411/542 |
| 4,561,226 | 12/1985 | Tourneur | 52/223 L |
| 4,616,458 | 10/1986 | Davis et al. | 52/223 L |

FOREIGN PATENT DOCUMENTS

| | | | |
|---|---|---|---|
| 482080 | 1/1970 | Switzerland | 52/230 |
| 993021 | 5/1965 | United Kingdom | 411/369 |
| 1027641 | 4/1966 | United Kingdom | 411/542 |

*Primary Examiner*—Michael Safavi

*Attorney, Agent, or Firm*—John F. Booth; Gerald G. Crutsinger; Norman L. Gundel

[57] ABSTRACT

A protective tendon tensioning anchor assembly comprising an anchor plate, a sealing cup and a resilient sealing ring for providing corrosion protection for exposed portions of a tendon secured in the tendon tensioning anchor assembly.

5 Claims, 4 Drawing Sheets

PROTECTIVE TENDON TENSIONING ANCHOR ASSEMBLIES

BACKGROUND OF THE INVENTION

1. Field of the Invention

The present invention relates to tendon tensioning anchor assemblies, and more particularly to improvements in sealing post-tension anchor assemblies to protect the exposed portions of a tendon from corrosion.

2. Description of the Prior Art

Conventional concrete reinforcing using tendons for stressing typically includes a pair of anchor assemblies mounted in spaced apart relation with an elongated reinforcing tendon extending therebetween. The tendon is placed under an axial load, either by pretensioning or post-tensioning, and connected to the concrete in the tensioned condition by the anchor assemblies. Tensioning of the tendon after the formation and setting of the concrete structure is known as post-tensioning and is widely used in the construction of prestressed concrete structures.

In the course of installing a tendon tensioning anchor assembly in a concrete structure, a hydraulic jack or the like is releasably attached to an exposed extending end of the tendon to apply a predetermined amount of tension to the tendon. The sheath, within which the remainder of the tendon is enclosed, protects against moisture and isolates the tendon from the surrounding concrete to facilitate the movement of the tendon relative to the surrounding concrete. When the desired amount of tension is applied to the tendon, wedges, threaded nuts or the like are used to connect the tendon to the anchor to hold the tendon in a stressed condition. After tensioning, the recessed ends of the tendon are cut off at the anchor by use of a cutting torch or the like.

Moisture travels through concrete. Concrete structures are frequently exposed to corrosive elements, such as de-icing chemicals, sea water, salt air or brackish water. In some environments, ground, water, run-off, snow and the like can immerse portions of the slab for substantial periods of time. The exposed ends of tendons from which the waterproof sheath has been stripped for tensioning can represent a substantial potential corrosion problem. Unless sealed against moisture, the exposed portions of the tendon are likely to suffer corrosion. This not only weakening the tendon, but the byproducts of the corrosive reaction can fracture the surrounding structure.

One method of protecting tendons is disclosed in U.S. Pat. No. 4,348,844 issued to Schupack et al on Sept. 14, 1982. According to the teachings of this patent, the entire anchor assembly is enclosed in a housing or envelope. The use of a housing enclosing the entire anchor assembly is unduly expensive and is subject to damage during the cutting of the exposed recessed tendon end by use of a cutting torch. Installation of the housing as a separate unit apart from the anchor plate assembly, is time consuming and costly. This increased cost is unnecessary because there is no need to protect the entire anchor plate assembly from corrosion so long as the tendon itself is protected. Further, this assembly relies on plastic threads to form the seal. The manufacturing tolerances, dirty environment, distortion from heat and potential for stress deformation can result in a less than a reliable seal arrangement. Other examples of anchor assemblies using unreliable pleastic thread seals and/or multiple parts are shown in U.S. Pat. Nos. 4,616,458, 4,343,122, 3,956,797 and 3,820,832 and the U.S. and foreign patents cited in these U.S. patents.

The U.S. Pat. No. 3,596,330, to Scott, discloses another method which uses a deformable plug pushed into place to form a seal. However, no means are provided for positively locking the seal in position to prevent it from being dislodged during grouting.

SUMMARY OF THE INVENTION

The present invention provides a reliable sealed anchor assembly which is simple and inexpensive to manufacture and install.

In accordance with the invention, an anchor body is provided for anchoring a tendon in a concrete slab. The anchor body cooperates with and engages a removable seal carrying cap to provide a positive seal therebetween to prevent the entrance of moisture into the interior of the anchor body. The cap locks in place to compress a trapezoidal cross-section shaped seal ring between two nonparallel seal surfaces on the body and cap to ensure a positive seal. At least one surface of the seal ring is provided with a protrusion to improve sealing against the anchor body.

The anchor body has a base plate for fixing the anchor body in place. A tubular portion for receiving the tendon therein extends from the base plate. Locking means cooperate with the anchor body for releasably connecting the tendon to the body after the tendon has been tensioned. A locking recess is formed on the interior of the tubular portion for engaging locking fingers on the cap to positively attach the cap to the anchor body. A seal ring carrying portion is formed on the cap to position the seal ring to engage a first seal surface on the cap and second seal engaging surface on the end of the tubular portion whereby the seal can be compressed therebetween.

This assembly utilizes a minimum of parts and provides a positive seal for use in a dirty environment whose integrity is independent of stress distortion, the destructive presence of heat in cutting off the exposed tendon ends and manufacturing tolerances.

DESCRIPTION OF THE DRAWINGS

The objects, features and advantages of the present invention will become apparent from the following detailed description of the invention and accompanying drawings in which.

DETAILED DESCRIPTION OF THE INVENTION

Figure 1:
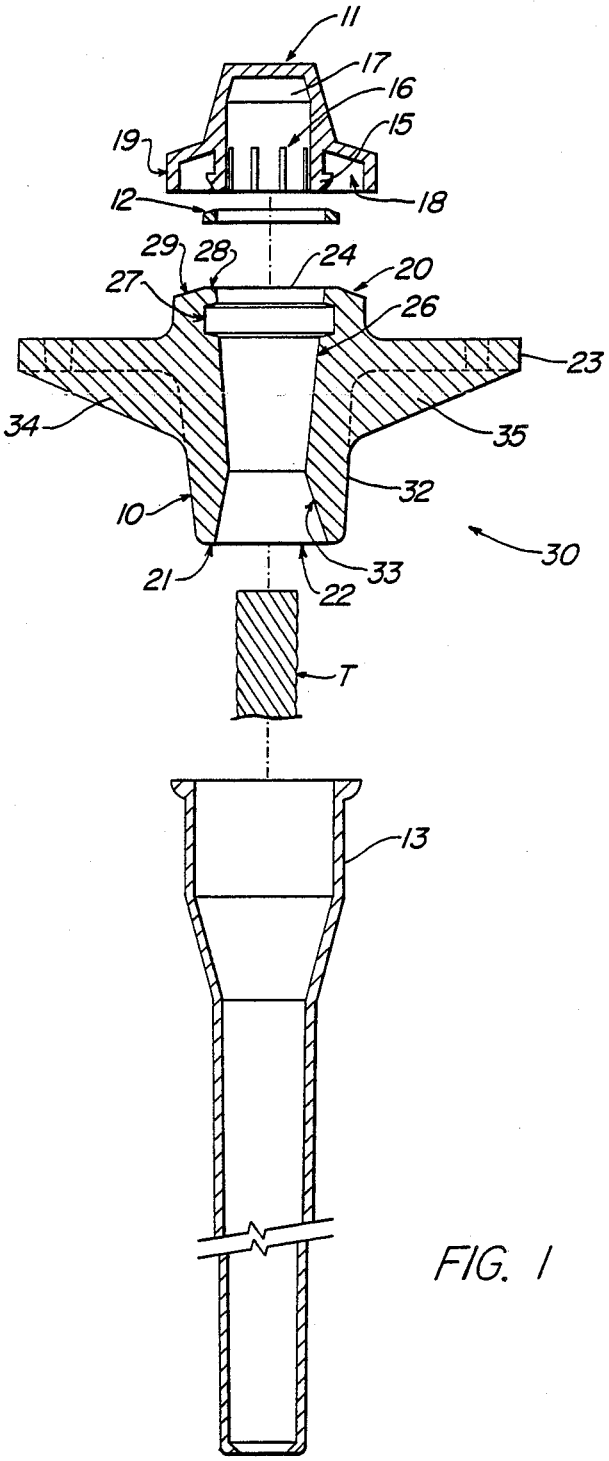
FIG. 1 is an exploded sectional view of the anchor assembly according to the present invention.

Referring to the drawings where like reference characters designate like or corresponding parts throughout the various figures, there is shown the improved anchor assembly of the the present invention which, for purposes of description, is designated by reference numeral 30. The anchor assembly 30 includes an anchor body 10, a sealing cap 11, a resilient annular seal 12, and a tubular trumpet member 13. Anchor body 10 can be formed from metallic material in a casting process. As a consequence of this manufacturing process, the surfaces of the body 10 can be rough and irregular. The body 10 has a tubular portion 21 with an external wall 32, a tendon receiving aperture 22 and a substantially larger diameter rear aperture 24 connected by a tapered central bore 26. Tapered central bore 26 is provided with a countersink 33 adjacent to the receiving aperture 22 for facilitating insertion of a tendon "T".

As shown in detail in FIG. 1 within the central bore 26 is formed an annular recess 27 located adjacent the aperture 24. Recess 27 forms a locking shoulder whose function will be hereinafter described in detail. Defining aperture 24 and extending radially to the external wall 32 of the tubular member 21 is a compound surface rim 20. Rim 20 comprises an annular seal engaging surface 28, and a cap mating shoulder 29. Surface 28 surrounds the rear aperture 24 and is aligned transverse to length of tubular portion 21. The cap mating shoulder 29 extends between surface 28 and the external wall of the tubular member 21. Shoulder 29 is outwardly inclined relative to the annular seal engaging surface 28.

Figure 3:
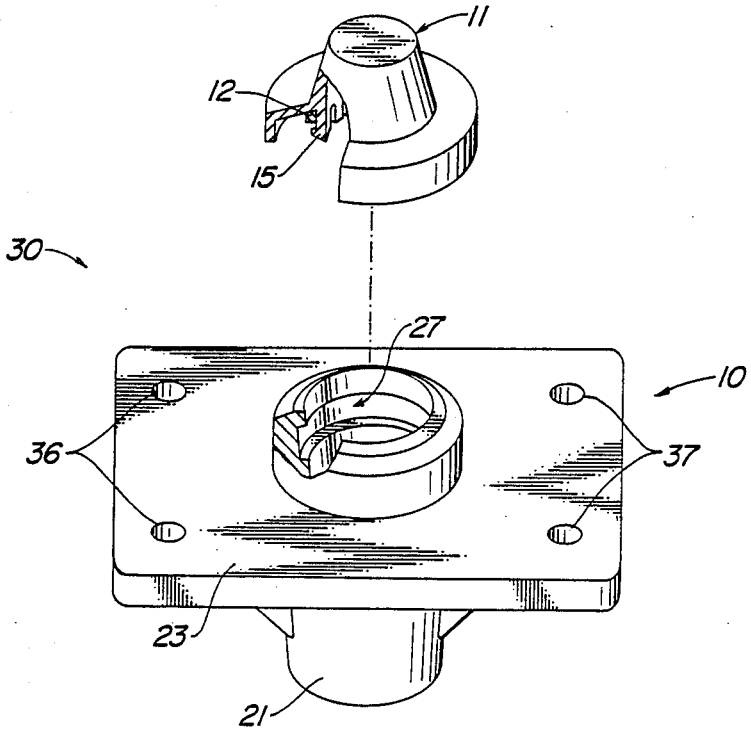
FIG. 3 is a perspective view of the anchor body and cap of the present invention.

As shown in FIGS. 1 and 3, extending outwardly from the external wall 32 of the tubular member 21 is a mounting flange 23 which is substantially planer and is aligned transverse to the length of member 21. Flange 23 is provided with a plurality of holes 36 and 37 for permitting the temporary attachment of the anchor body 10 to form members while pouring and hardening of the surrounding concrete. Extending outwardly from the external wall 32 of the tubular member 22 and connected to the mounting flange 23 are reinforcing ribs 34 and 35.

Figure 5:
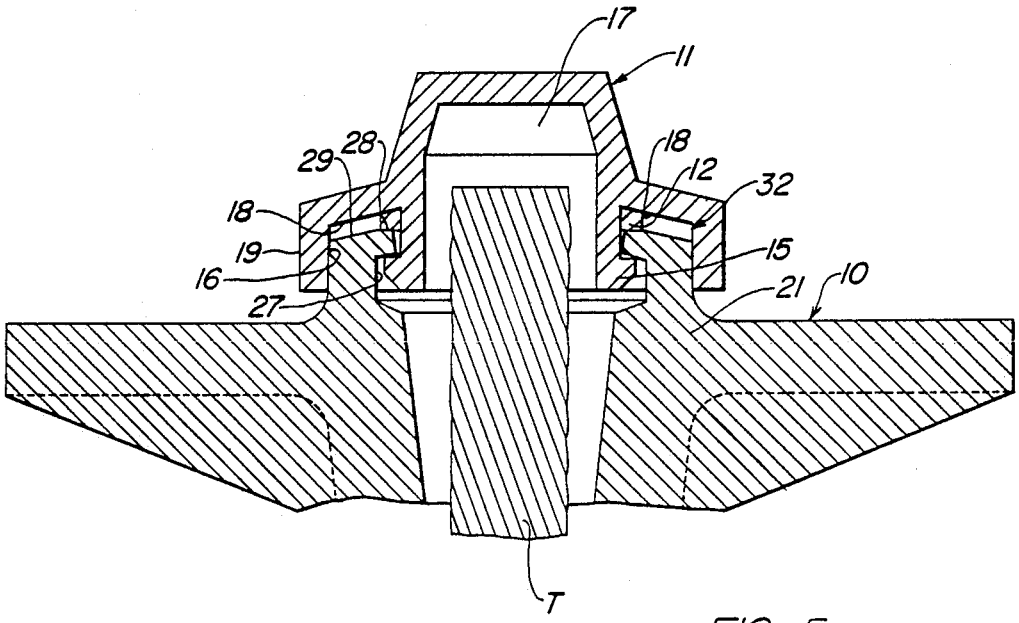
FIG. 5 is an enlarged cross-sectional view of the cap and resilient seal installed on an anchor body.

As shown in FIGS. 3 and 5, sealing cap 11 has a central cavity 17. A receiving collar 19 provides a close telescoping fit over and around the tubular member 21 such that in the assembled condition, the inside wall 16 of the receiving collar 19, engages the external wall 32 of the tubular member 21 to help properly align the cap 11 in position. Within cavity 17, is provided an annular frusto-conical sealing surface 18 correspondingly inclined to mate with shoulder 29 when the cap 11 is position as shown in FIG. 5.

A plurality of circumferentially spaced resilient locking fingers 15 provide a means for securing the sealing cap 11 to the tubular member 21. The locking fingers 15 being engagable with the shoulder in annular recess 27.

In the preferred embodiment, a plurality of guide fingers (not shown) are positioned between the locking fingers 15. Guide fingers are adapted to telescope in a close fitting arrangement into bore 26. Within the cylindrical space defined by the locking fingers 15 and the guide fingers, there is defined a chamber for the severed end of a tendon "T".

Figure 4:
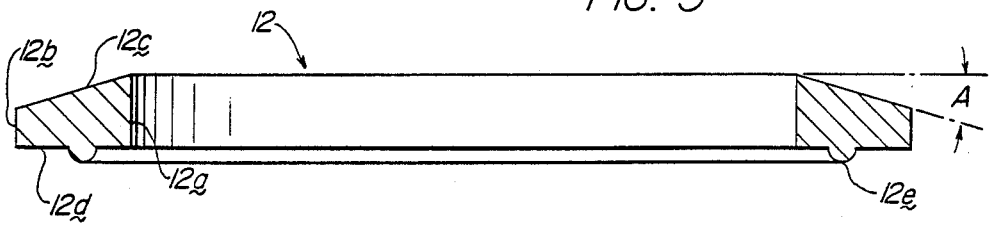
FIG. 4 is an enlarged cross-sectional view of a resilient seal ring.

In the preferred embodiment, seal 12, is positioned within the central cavity 17 of the sealing cup 11, contacting the annular frusto-conical sealing surface 18 and closely fitted around the circular formation of locking fingers 15 and the guide fingers. The resilient annular seal 12, best illustrated in FIG. 4, has a trapezoidal cross-section shape. Seal ring 12 has generally cylindrical inner and outer surfaces 12a and 12b which intersect non-parallel faces 12c and 12d. Face 12c is preferably inclined at an angle "A" of, for example, twenty degrees relative to face 12d. To facilitate forming a seal against annular seal engaging surface 28, an annular projection or bead 12e is formed to extend from face 12d intermediate inner and outer surfaces 12a and 12b. Bead 12e has a small radius, for example, 3/64th inch if face 12d is 0.40 inch, to provide a ring of increased bearing pressure to facilitate deformation of bead 12e such that resilient material flows and deforms to seal against roughened portions of surface 28.

The shape of seal ring 12 permits a frusto-conical mating between seal and the frusto-conical sealing surface 18 when the cap 11 is in place. The trapezoidal configuration of the resilient annular seal 12 permits a watertight seal having a range of sealing integrity substantially greater than that of a conventional O-ring seal. This range responds to potential variations in axial distance between the annular frusto-conical sealing surface 18 of the sealing cap 11 and the annular seal engaging surface 28. These variations in axial distance being frequently encountered in the process of mass production of mating components.

Trumpet member 13 has a central bore corresponding to the tendon axis, enshrouds the receiving aperture 22 of the tubular member 21 and can be conventionally sealed to the tendon "T".

Figure 2:
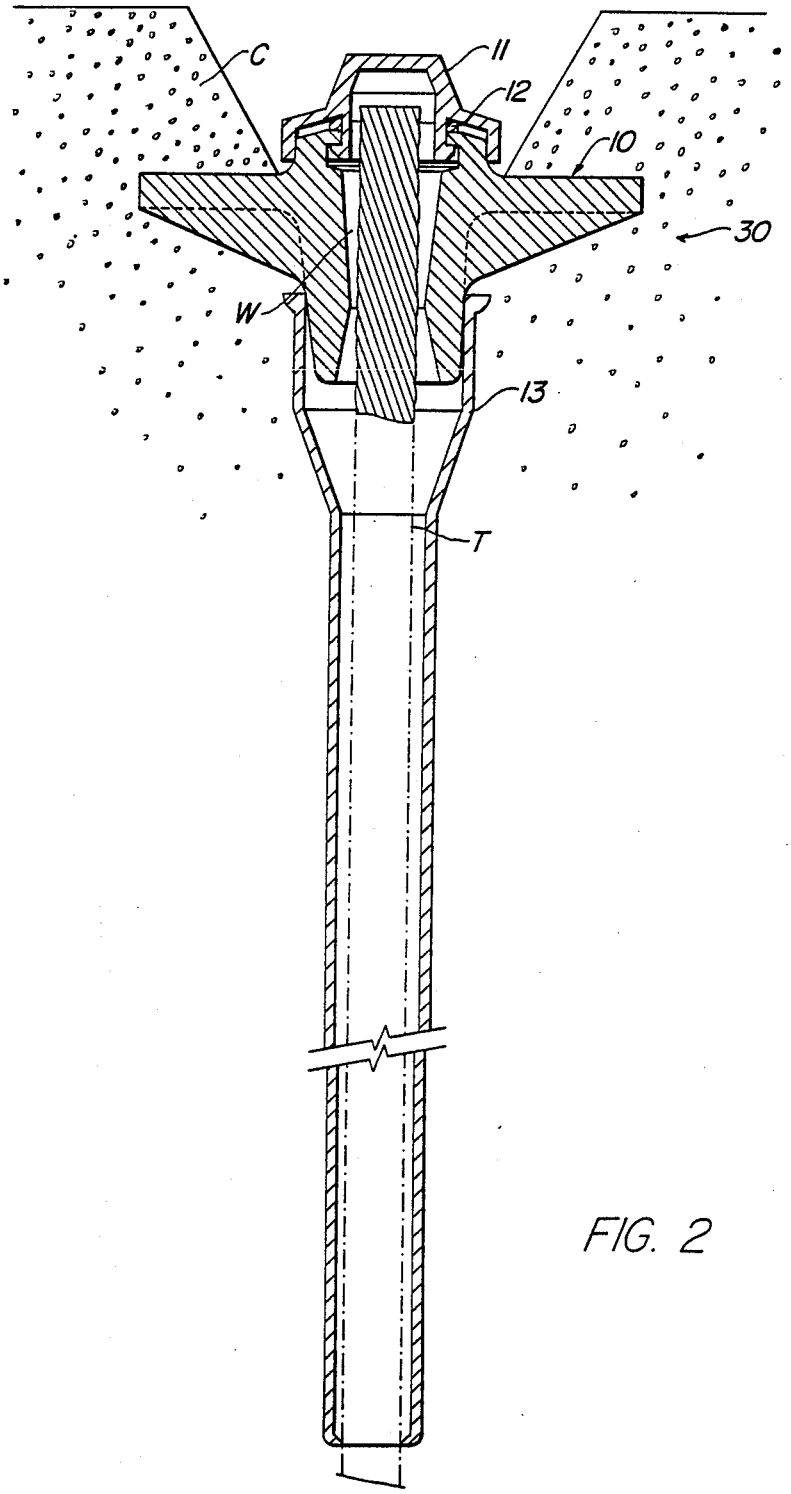
FIG. 2 is a sectional view of the anchor assembly of FIG. 1.

In use, once the anchor body 10 has been set in concrete "C" in a recessed position as shown in FIG. 2, the tendon "T" can be engaged and tensioned in a conventional manner. Tensioned locks or wedges "W" are used to lock the tendon to the anchor. The extending end of the tendon can be cut off using a cutting torch or the like. Use of a cutting torch allows the tendon to be quickly cut off in the recess so that the end is flush with the upper surface of the anchor body 10. During this cutting process, any exposed plastic parts of the anchor sealing assembly would be exposed to destructive heat. As can be seen in the present invention, no plastic parts or threads are exposed to the intense heat of the cable cutting process. Once the cable is cut, the sealing cap 11 is pushed into the locked sealing position shown in FIG. 5.

the embodiment shown and described in this application is but one embodiment for accomplishing applicant's invention. It is to be understood that the present invention shall include all embodiments of the invention as defined in the accompanying claims.

What is claimed is:

1. A sealed anchor assembly for use in anchoring a post tensioning tendon in a concrete structure, comprising:

an anchor body for mounting in the concrete structure and for connection to the tendon, said anchor body having a bore extending therethrough of a size and shape to allow said tendon to extend through said bore; tendon mounting surface means in said bore for connection to said tendon, surface means on said body extending transverse to said bore, a raised rim on said body surrounding one end of said bore, an annular sealing surface formed on said rim, a sealing cap for mounting on said body to close and seal said one end of said bore to prevent the ingress through said one end of harmful materials into said bore; said cap having a collar to closely fit over and around said rim, an annular sealing surface on the interior of said cap for cooperation with said sealing surface on said body, finger means on said cap for locking said cap in place on said body closing said one end of said bore, said fingers extending from said cap, surface means on said finger means for engaging said transversely extending surface means on said body to lock said cap on said body, a resilient annular seal means for mounting on said cap to seal between said cap and said body, said seal means being of a size and shape to engage and be compressed between said sealing surfaces on said body and said cap when said cap is locked in place on said body, and a tubular trumpet member for mounting on said body at the end of said bore, opposite said one end said trumpet member having an opening therethrough of a size and shape to fit around the tendon when said tendon extends into said body.

2. A sealed anchor assembly according to claim 1 wherein each of said annular sealing surfaces on said body and cap comprises a frusto-conical portion.

3. A sealed anchor assembly according to claim 1 wherein said transverse surface means on said body is located in an annular recess formed in said bore.

4. A sealed anchor assembly according to claim 1 wherein said body has a tubular portion adjacent the end of said bore opposite said one end and wherein said tubular trumpet member has an end portion permitting a telescopic engagement over and around said tubular body portion on said body whereby said trumpet is mounted on said body in sealing configuration with the exterior of said tubular portion on said body.

5. A sealed anchor assembly for use in anchoring a post tensioning tendon in a concrete structure, comprising:

an anchor body for mounting in the concrete structure and for connection to the tendon, said anchor body having a bore extending therethrough of a size and shape to allow said tendon to extend through said bore; tendon mounting surface means in said bore for connection to said tendon; surface means in an annular recess formed in said bore, said surface means extending transverse to said bore; a raised rim on said body surrounding one end of said bore; an annular sealing surface formed on said rim;

a sealing cap for mounting on said body to close and seal said one end of said bore to prevent the ingress through said one end of harmful materials into said bore, said cap having a collar to closely fit over and around said rim; an annular sealing surface on the interior of said cap for cooperation with said sealing surface on said body, frusto-conical portions of said annular sealing surfaces on said body and cap; locking finger means on said cap positioned to extend into said bore and along the wall of said bore when said cap is mounted on said bore for locking said cap in place on said body closing said one end of said bore, said fingers extending from said cap; surface means on said finger means for engaging said transversely extending surface means on said body to lock said cap on said body;

a resilient annular seal means for mounting on said cap to seal between said cap and said body, said seal means being of a size and shape to engage and be compressed between said sealing surfaces on said body and said cap when said cap is locked in place on said body; and a tubular trumpet member for mounting on said body at the end of said bore, opposite said one end said trumpet member having an opening therethrough of a size and shape to fit around the tendon when said tendon extends into said body.

* * * * *